US009955725B2

(12) United States Patent
Yamada et al.

(10) Patent No.: US 9,955,725 B2
(45) Date of Patent: May 1, 2018

(54) MANUFACTURING METHOD FOR CARBON HEAT SOURCE

(71) Applicant: JAPAN TOBACCO INC., Tokyo (JP)

(72) Inventors: Manabu Yamada, Tokyo (JP); Takeshi Akiyama, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days. days.

(21) Appl. No.: 15/337,898

(22) Filed: Oct. 28, 2016

(65) Prior Publication Data

US 2017/0042226 A1 Feb. 16, 2017

Related U.S. Application Data

(63) Continuation of application No. PCT/JP2014/062024, filed on Apr. 30, 2014.

(51) Int. Cl.

| | |
|---|---|
| ***A24F 47/00*** | (2006.01) |
| ***C10L 5/06*** | (2006.01) |
| ***C10L 5/34*** | (2006.01) |
| ***A24B 15/16*** | (2006.01) |
| ***C10L 9/00*** | (2006.01) |
| ***C10L 5/26*** | (2006.01) |
| ***C10L 5/36*** | (2006.01) |

(52) U.S. Cl.

CPC ..... *A24F 47/006* (2013.01); *A24B 15/165* (2013.01); *A24F 47/00* (2013.01); *C10L 5/06* (2013.01); *C10L 5/26* (2013.01); *C10L 5/34* (2013.01); *C10L 5/36* (2013.01); *C10L 9/00* (2013.01); *C10L 2270/08* (2013.01)

(58) Field of Classification Search

CPC combination set(s) only.
See application file for complete search history.

(56) References Cited

U.S. PATENT DOCUMENTS

| | | | | |
|---|---|---|---|---|
| 2007/0215168 | A1* | 9/2007 | Banerjee ..... | A24B 15/165 131/335 |
| 2009/0065011 | A1 | 3/2009 | Maeder et al. | |
| 2015/0013703 | A1 | 1/2015 | Akiyama et al. | |

FOREIGN PATENT DOCUMENTS

| | | | |
|---|---|---|---|
| JP | 57-129682 | A | 8/1982 |
| JP | 2539056 | Y2 | 6/1997 |
| JP | 2010-535530 | A | 11/2010 |
| WO | WO 2013/146951 | A2 | 10/2013 |

* cited by examiner

*Primary Examiner* — Ellen McAvoy
*Assistant Examiner* — Chantel Graham
(74) *Attorney, Agent, or Firm* — Birch, Stewart, Kolasch & Birch, LLP

(57) ABSTRACT

A manufacturing method for a carbon heat source comprises: a step A1 of forming a first groove in a state where the plurality of carbon members are aligned in one line; a step A2 of changing, subsequent to the step A1 being performed, an orientation of the plurality of carbon members so that the first groove formed in the plurality of carbon members crosses relative to the first predetermined direction in a state where the plurality of carbon members are aligned in one line; and a step A3 of forming, subsequent to the step A2 being performed, a second groove in a state where the plurality of carbon members are aligned in one line.

8 Claims, 12 Drawing Sheets

MANUFACTURING METHOD FOR CARBON HEAT SOURCE

CROSS REFERENCE TO RELATED APPLICATIONS

This application is a Continuation of PCT International Application No. PCT/JP2014/062024, filed on Apr. 30, 2014, which is hereby expressly incorporated by reference into the present application.

TECHNICAL FIELD

The present invention relates to a manufacturing method for a carbon heat source extending from an ignition end toward a non-ignition end.

BACKGROUND ART

Conventionally, instead of a cigarette, a flavor inhaler (smoking article) is proposed which allows for tasting a flavor without burning a flavor source such as a tobacco. For example, there is known a flavor inhaler including: a carbon heat source extending along a direction from an ignition end toward a non-ignition end (hereinafter, referred to as "longitudinal axis direction") and a holder that holds the carbon heat source. There are various types of proposals for such a flavor inhaler. For example, W02013/146951 A1 describes a flavor inhaler provided with a cylinder-shaped carbon heat source having a through-hole with a diameter of 1.5 to 3 mm.

An attempt has been made to improve ignitibility of the carbon heat source by forming a plurality of grooves at the ignition end of the cylinder-shaped carbon heat source having a through-hole. The plurality of grooves includes a first groove and a second groove respectively crossing at the ignition end of the carbon heat source. See, for example JP 2010-535530A.

There is a proposal for a technique to form a cross groove at an end surface of a predetermined member. For example, Japanese Utility Model Registration No. 2539056describes a processing apparatus for forming a cross groove by utilizing the turning of a table holding the predetermined member. More specifically, the processing apparatus has a table on which to hold the predetermined member and a cutter configured to reciprocate in a constant direction. The processing apparatus forms the first groove as a result of the cutter abutting the end surface of the predetermined member, in a state where a position of the predetermined member held on the table is in a first position. Subsequently, the processing apparatus turns the table holding the predetermined member, while not rotating the same, by 90° . As a result, the position of the predetermined member held on the table is changed from the first position to the second position. In other words, the orientation of the predetermined member is turned by 90° . Subsequently, the processing apparatus forms the second groove as a result of the cutter abutting the end surface of the predetermined member, in a state where the position of the predetermined member held on the table is in a second position.

However, in the above-described processing apparatus, the groove is formed by a semi-batch process using the table, and thus, it is difficult to continuously manufacture a large number of carbon heat sources. Further, in the above-described processing apparatus, as the predetermined member in which the cross groove is formed, a carbon heat source configured by a carbon material is not assumed.

SUMMARY

A first feature is a manufacturing method for a carbon heat source having an ignition end, the ignition end formed with a plurality of respectively crossing grooves, the method comprising: a step A of forming a plurality of grooves at the ignition end of a plurality of carbon members that extend along a longitudinal axis direction from the ignition end toward a non-ignition end and that have a pillar-like profile, wherein the step A includes: a step A1 of forming a first groove along a first predetermined direction by bringing the ignition end of each of the plurality of carbon members into contact with a first groove cutting member in a state where the plurality of carbon members are aligned in one line along the first predetermined direction while transporting the plurality of carbon members along the first predetermined direction; a step A2 of changing, subsequent to the step A1 being performed, an orientation of the plurality of carbon members so that the first groove formed in the plurality of carbon members crosses relative to the first predetermined direction in a state where the plurality of carbon members are aligned in one line while transporting the plurality of carbon members; and a step A3 of forming, subsequent to the step A2 being performed, a second groove crossing the first groove along a second predetermined direction by bringing the ignition end of each of the plurality of carbon members into contact with a second groove cutting member in a state where the plurality of carbon members are aligned in one line along the second predetermined direction while transporting the plurality of carbon members along the second predetermined direction.

In the first feature, the step A2 is a step of turning each of the plurality of carbon members around a turning axis along the longitudinal axis direction by a speed difference between a pair of transport belts while transporting the plurality of carbon members by the pair of transport belts, the pair of transport belts sandwiching the plurality of carbon members from side surfaces of the plurality of carbon members.

In the first feature, the second predetermined direction crosses the first predetermined direction, the step A1 includes a step of transporting the plurality of carbon members along the first predetermined direction by a pair of first transport belts, the pair of first transport belts sandwiching the plurality of carbon members from side surfaces of the plurality of carbon members, the step A3 includes a step of transporting the plurality of carbon members along the second predetermined direction by a pair of second transport belts, the pair of second transport belts sandwiching the plurality of carbon members from side surfaces of the plurality of carbon members, and the step A2 is a step of passing the plurality of carbon members from the pair of first transport belts to the pair of second transport belts.

In the first feature, the step A1 includes a step of transporting the plurality of carbon members along the first predetermined direction by a pair of first transport belts, the pair of first transport belts sandwiching the plurality of carbon members from side surfaces of the plurality of carbon members, the step A3 includes a step of transporting the plurality of carbon members along the second predetermined direction by a pair of second transport belts, the pair of second transport belts sandwiching the plurality of carbon members from side surfaces of the plurality of carbon members, the pair of first transport belts have a protrusion to prevent each turning of the plurality of carbon members in the step A1, and the pair of second transport belts have a protrusion to prevent each turning of the plurality of carbon members in the step A2.

In the first feature, the step A1 includes a step of transporting the plurality of carbon members along the first predetermined direction, by using a plurality of holders individually holding each of the plurality of carbon members, the step A3 includes a step of transporting the plurality of carbon members along the second predetermined direction by using the plurality of holders, and the step A2 is a step of turning each of the plurality of carbon members around a turning axis along the longitudinal axis direction by the turning of each of the plurality of holders.

In the first feature, the manufacturing method for a carbon heat source further comprises a step B of chamfering an outer circumference of the ignition end of the plurality of carbon members.

In the first feature, the manufacturing method for a carbon heat source comprises the step B before the step A.

In the first feature, the manufacturing method for a carbon heat source comprises the step B after the step A.

In the first feature, the step B includes: a step B1 of turning each of the plurality of carbon members around a turning axis along the longitudinal axis direction by a speed difference between a pair of transport belts while transporting the plurality of carbon members by the pair of transport belts sandwiching the plurality of carbon members from side surfaces of the plurality of carbon members, in a state where the plurality of carbon members are aligned in one line along a predetermined direction; and a step B2 of bringing a chamfering member disposed along the predetermined direction into contact with an outer circumference of the ignition end, in a state where each of the plurality of carbon members is turned around the turning axis.

DESCRIPTION OF THE EMBODIMENT

Figure 1:
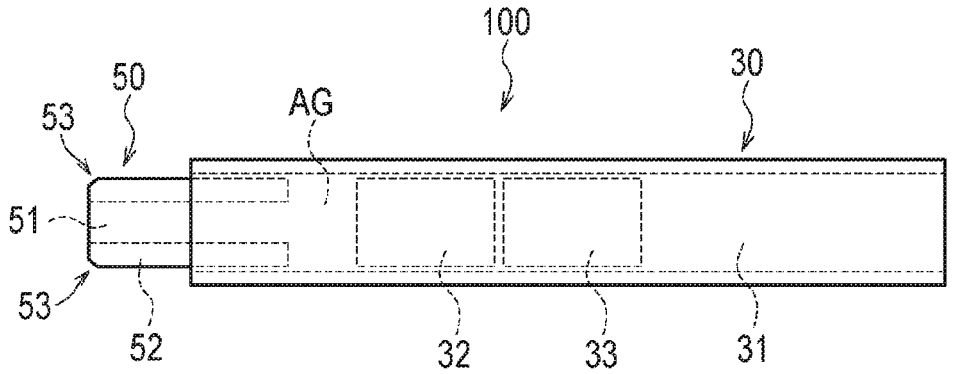
FIG. 1 is a drawing showing a flavor inhaler 100 according to a first embodiment.

Hereinafter, the embodiments of the present invention will be described with reference to the drawings. In the following drawings, identical or similar components are denoted by identical or similar reference numerals. However, it should be noted that the drawings are schematic, and the ratio and the like of each of the dimensions is different from the reality.

Therefore, specific dimensions should be determined with reference to the description below. It is needless to mention that different relationships and ratio of dimensions may be included in different drawings.

[Overview of Embodiment]

A manufacturing method for a carbon heat source according to an embodiment is a manufacturing method for a carbon heat source having an ignition end formed with a plurality of respectively crossing grooves. The manufacturing method for a carbon heat source comprises a step B of chamfering an outer circumference of the ignition end of a plurality of carbon members that extend along a longitudinal axis direction from the ignition end toward a non-ignition end and that have a pillar-like profile, and a step A of forming the plurality of grooves at the ignition end. The step A includes: a step A1 of forming a first groove along a first predetermined direction by bringing an ignition end of each of the plurality of carbon members into contact with a first groove cutting member in a state where the plurality of carbon members are aligned in one line along the first predetermined direction while the plurality of carbon members are being transported along the first predetermined direction; a step A2 of changing, subsequent to the step Al being performed, an orientation of the plurality of carbon members so that the first groove formed in the is plurality of carbon members crosses relative to the first predetermined direction in a state where the plurality of carbon members are aligned in one line while the plurality of carbon members are being transported; and a step A3 of forming, subsequent to the step A2 being performed, along the second predetermined direction, a second groove crossing the first groove by bringing an ignition end of each of the plurality of carbon members into contact with a second groove cutting member in a state where the plurality of carbon members are aligned in one line along the second predetermined direction while the plurality of carbon members are being transported along the second predetermined direction.

In the embodiment, when the step A2 of changing the orientation of the plurality of carbon members is executed between the step A1 and the step A3,the first groove and the second groove crossing the first groove are formed in a state where the plurality of carbon members are aligned in one line. Accordingly, it is possible to continuously manufacture a large number of carbon heat sources formed with a cross groove, and possible to improve a productivity of the carbon heat source.

[First Embodiment]

(Flavor Inhaler)

Figure 2:
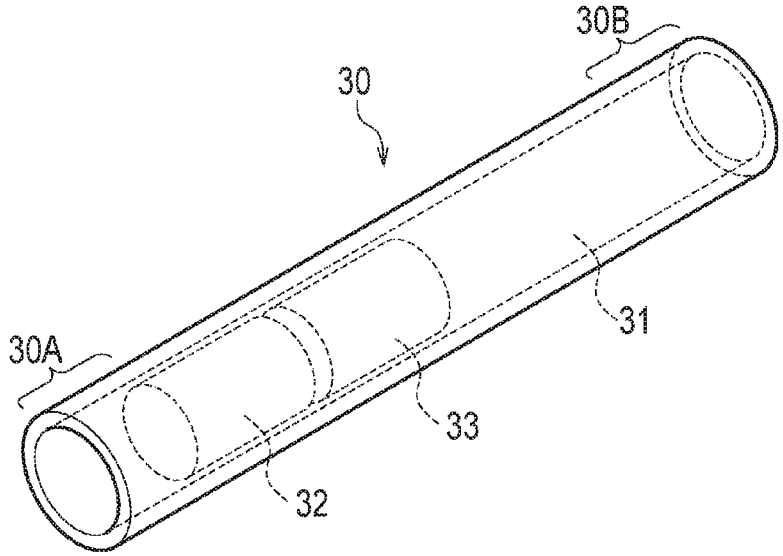
FIG. 2 is a drawing showing a holder 30 according to the first embodiment.
Figure 3:
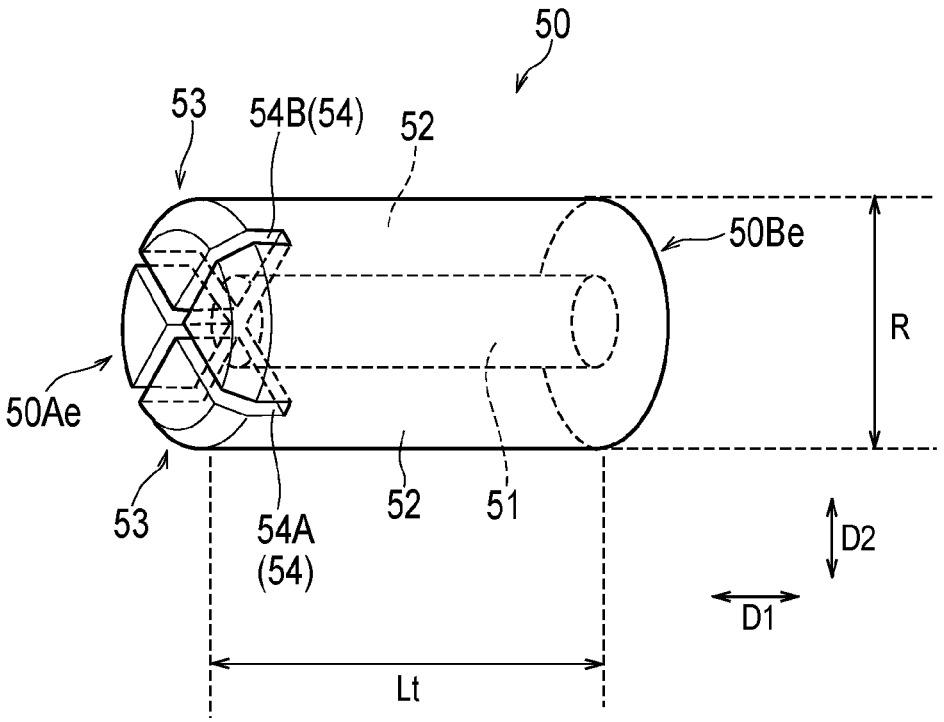
FIG. 3 is a drawing showing a burning type heat source 50 according to the first embodiment.

A flavor inhaler according to a first embodiment will be described, below. FIG. 1 is a drawing showing a flavor inhaler 100 according to the first embodiment. FIG. 2 is a drawing showing a holder 30 according to the first embodiment. FIG. 3 is a drawing showing a burning type heat source 50 according to the first embodiment.

As shown in FIG. 1, the flavor inhaler 100 has the holder 30 and the burning type heat source 50. In the first embodiment, it should be noted that the flavor inhaler 100 is a flavor inhaler without burning a flavor source.

As shown in FIG. 2, the holder 30 holds the burning type heat source 50. The holder 30 has a supporting end portion 30A and a mouthpiece end portion 30B. The supporting end portion 30A is an end portion that holds the burning type heat source 50. The mouthpiece end portion 30B is an end portion provided at a mouthpiece side of the flavor inhaler. In the first embodiment, the mouthpiece end portion 30B configures a mouthpiece of the flavor inhaler 100. However, the mouthpiece of the flavor inhaler 100 may be provided separately of the holder 30.

The holder 30 is of a cylindrical shape having a hollow 31 extending along a direction from the supporting end portion 30A toward the mouthpiece end portion 308. For example, the holder 30 has a cylindrical shape or a rectangular tubular shape.

In the first embodiment, the holder 30 may be a paper tube formed by bending rectangular-shaped thick paper into a cylindrical shape after which the both edge portions are joined to each other.

In the first embodiment, the holder 30 houses a flavor source 32. The flavor source 32 has a circular cylindrical shape, which is formed by covering a granular tobacco leaf with a sheet having air permeability, for example. Alternatively, as the flavor source 32, for example, it is possible to use a tobacco leaf and employ general shredded tobacco used in a cigarette (paper-wrapped tobacco), granular tobacco used in a snuff, and a tobacco raw material of a roll tobacco, a tobacco compact, etc. Further, a support made of a porous material or a non-porous material may be employed as the flavor source 32. It is noted that the roll tobacco is obtained by forming a sheet-like regenerated tobacco into a roll, and has a flow path therein. Further, the tobacco compact is obtained by mold-forming the granular tobacco. Moreover, the tobacco raw material or the support used as the above-described flavor source 32 may include a desired flavoring agent.

Further, the holder 30 may include a straightening member 33. The straightening member 33 is provided at the mouthpiece end portion 30B side with respect to the flavor source 32. The straightening member 33 has a through hole extending along a direction from the supporting end portion 30A toward the mouthpiece end portion 30B. The straightening member 33 is formed by a member that does not have air permeability.

In the first embodiment, a case in which the holder 30 has a cylindrical shape is shown as an example; however, the embodiment is not limited thereto. That is, the holder 30 may suffice to have a configuration for holding the burning type heat source 50.

Here, as shown in FIG. 1, an air gap AG may be provided between the burning type heat source 50 held by the holder 30 and the flavor source 32 provided in the holder 30, and the burning type heat source 50 and the flavor source 32 may be directly adjacent to each other.

As shown in FIG. 3, the burning type heat source 50 has an ignition end portion 50Ae and a non-ignition end portion 50Be. The ignition end portion 50Ae is an end portion that is exposed from the holder 30 in a state where the burning type heat source 50 is inserted into the holder 30. The non-ignition end portion 50Be is an end portion that is inserted into the holder 30.

Specifically, the burning type heat source 50 has a shape extending along a first direction D1 from the ignition end 50Ae toward the non-ignition end 50Be. The burning type heat source 50 has a longitudinal hollow 51, a side wall 52, a chamfered portion 53, and a groove 54 (a groove 54A and a groove 54B).

The longitudinal hollow 51 extends along the first direction D1 from the ignition end 50Ae toward the non-ignition end 50Be. The longitudinal hollow 51 is preferably provided at an approximately center of the burning type heat source 50 as seen in a perpendicular cross section perpendicular to the first direction D1. That is, the thickness of a wall body (the side wall 52) configuring the longitudinal hollow 51 is preferably constant in the perpendicular cross section perpendicular to the first direction D1.

It is preferable that in the first embodiment, the number of longitudinal hollows 51 formed in the burning type heat source 50 is singular. The longitudinal hollow 51 has a first cross section area in a perpendicular cross section perpendicular to the first direction D1. The first cross section area of the longitudinal hollow 51A is 1.77 $mm^2$ or more.

The burning type heat source 50 is configured by a combustible substance. For example, examples of the combustible substance include a mixture comprising a carbonaceous material, a noncombustible additive, a binder (organic binder or inorganic binder), and water. As the carbon material, that which is obtained by removing a volatile impurity through a heat treatment, etc., is preferably used.

When the weight of the burning type heat source 50 is 100 wt %, the burning type heat source 50 preferably comprises a carbonaceous material in a range of 30 wt % to 70 wt %, and more preferably comprises a carbonaceous material in a range of 40 wt % to 50 wt %. When the burning type heat source 50 comprises a carbonaceous material in the preferable range, it is possible to achieve a more appropriate burning characteristic such as supply of a heat amount and a property of preventing falling-off of an ash.

Examples which may be used as the organic binder may include a mixture including at least one of CMC-Na (carboxymethyl-cellulose sodium), CMC (carboxymethyl cellulose), alginate, EVA, PVA, PVAC, and saccharides.

Examples which may be used as the inorganic binder may include a mineral-based binder such as purified bentonite or a silica-based binder such as colloidal silica, water glass, and calcium silicate.

For example, in view of a flavor, when the weight of the side wall 52 is 100 wt %, the binder preferably comprises 1 wt % to 10 wt % of CMC-Na, and more preferably comprises 1 wt % to 8 wt % of CMC-Na.

Examples which may be used as the incombustible additive may include a carbonate or an oxide including sodium, potassium, calcium, magnesium, and silicon, for example. The side wall 52 may comprise 40 wt % to 89 wt % of incombustible additive when the weight of the side wall 52 is 100 wt %. Further, when calcium carbonate is used as the incombustible additive, the side wall 52 preferably comprises 40 wt % to 55 wt % of incombustible additive.

The side wall 52 may, in order to improve a burning characteristic, comprise 1 wt % or less of alkali metal salts such as sodium chloride when the weight of the side wall 52 is 100 wt %.

The chamfered portion 53 is arranged along the outer circumference of the ignition end 50Ae, and has an inclination relative to the perpendicular cross section perpendicular to the first direction D1.

The groove 54 is formed in the ignition end 50Ae and is communicated to the longitudinal hollow 51. The groove 54 is configured by the groove 54A and the groove 54B, and the groove 54A and the groove 54B cross each other and have a straight-line shape.

In the first embodiment, the size (Lt shown in FIG. 3) of the burning type heat source 50 in the first direction D1 is preferably 5 mm or more and 30 mm or less. Further, the size (R shown in FIG. 3) of the burning type heat source 50 in the second direction D2 perpendicular to the first direction D1 is preferably 3 mm or more and 15 mm or less.

Here, when the burning type heat source 50 has a cylindrical shape, the size of the burning type heat source 50 in the second direction D2 is an outer diameter of the burning type heat source 50. When the burning type heat source 50 does not have a cylindrical shape, the size of the burning type heat source 50 in the second direction D2 is a maximum value of the burning type heat source 50 in the second direction D2.

(Manufacturing Method for Carbon Heat Source)

Figure 4:
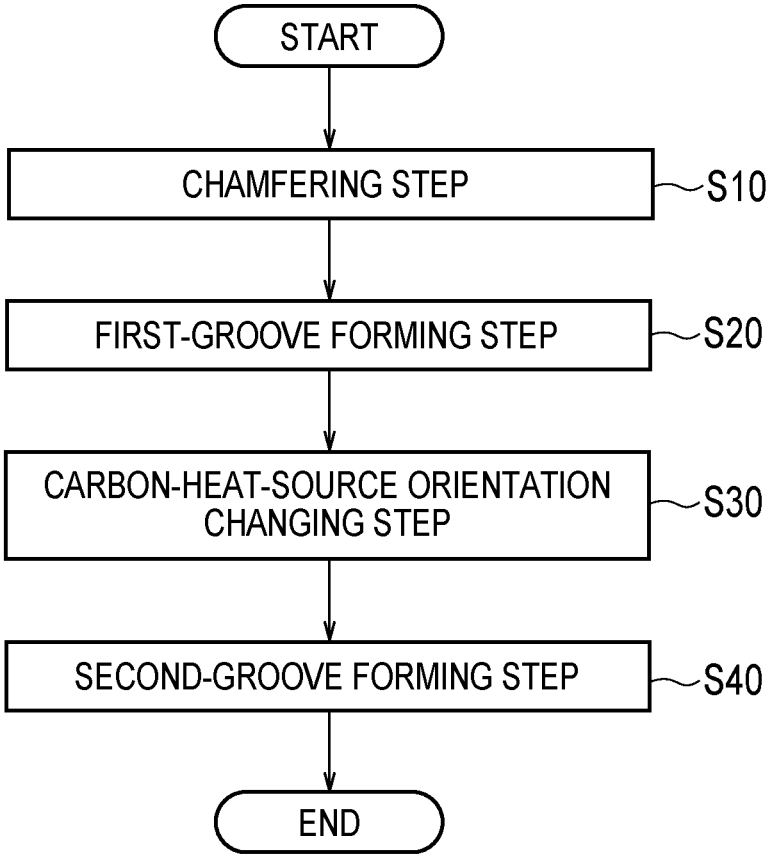
FIG. 4 is a flowchart showing a manufacturing method for the burning type heat source 50 according to the first embodiment.

A manufacturing method for a carbon heat source according to the first embodiment will be described, below. FIG. 4 is a flowchart showing the manufacturing method for the burning type heat source 50 according to the first embodiment.

As shown in FIG. 4, step S10 is a step (step B) of forming the chamfered portion 53 arranged in the ignition end 50Ae of the burning type heat source 50. Specifically, in step S10, an outer circumference of the ignition end of a plurality of carbon members that extend along a longitudinal axis direction from the ignition end toward a non-ignition end and that have a pillar-like profile is chamfered.

It is noted that not particularly limited, but before starting step S10, it is preferable that the carbon member already has the longitudinal hollow 51. Such a carbon member is formed by extrusion molding, for example.

Step S20 is a step (the step A1) of forming the groove 54 (that is, either one of the groove 54A or the groove 54B) arranged in the ignition end 50Ae of the burning type heat source 50. Specifically, in step S20, the first groove is formed along a first predetermined direction by bringing the ignition end of each of the plurality of carbon members into contact with a first groove cutting member in a state where the plurality of carbon members are aligned in one line along the first predetermined direction while the plurality of carbon members are being transported along the first predetermined direction.

Step S30 is a step (the step A2) of changing the orientation of the plurality of carbon members, after step S20 has been performed. Specifically, in step S30, an orientation of the plurality of carbon members is changed so that the first groove formed in the plurality of carbon members crosses relative to the first predetermined direction in a state where the plurality of carbon members are aligned in one line while the plurality of carbon members are being transported.

Step S40 is a step (the step A3) of forming the groove 54 (that is, the other of the groove 54A and the groove 54B) arranged in the ignition end 50Ae of the burning type heat source 50, after step S30 has been performed. Specifically, in step S40, a second groove which crosses the first groove is formed along a second predetermined direction by bringing an ignition end of each of the plurality of carbon members into contact with a second groove cutting member in a state where the plurality of carbon members are aligned in one line along the second predetermined direction while the plurality of carbon members are being transported along the second predetermined direction. It is noted that in the first embodiment, a crossing angle between the first groove and the second groove may be appropriately set. The crossing angle preferably is 30° to 150°.

In the first embodiment, it should be noted that step S20 to step S40 are the step A of forming a plurality of grooves at the ignition end.

(Example of Chamfering Step)

Figure 5:
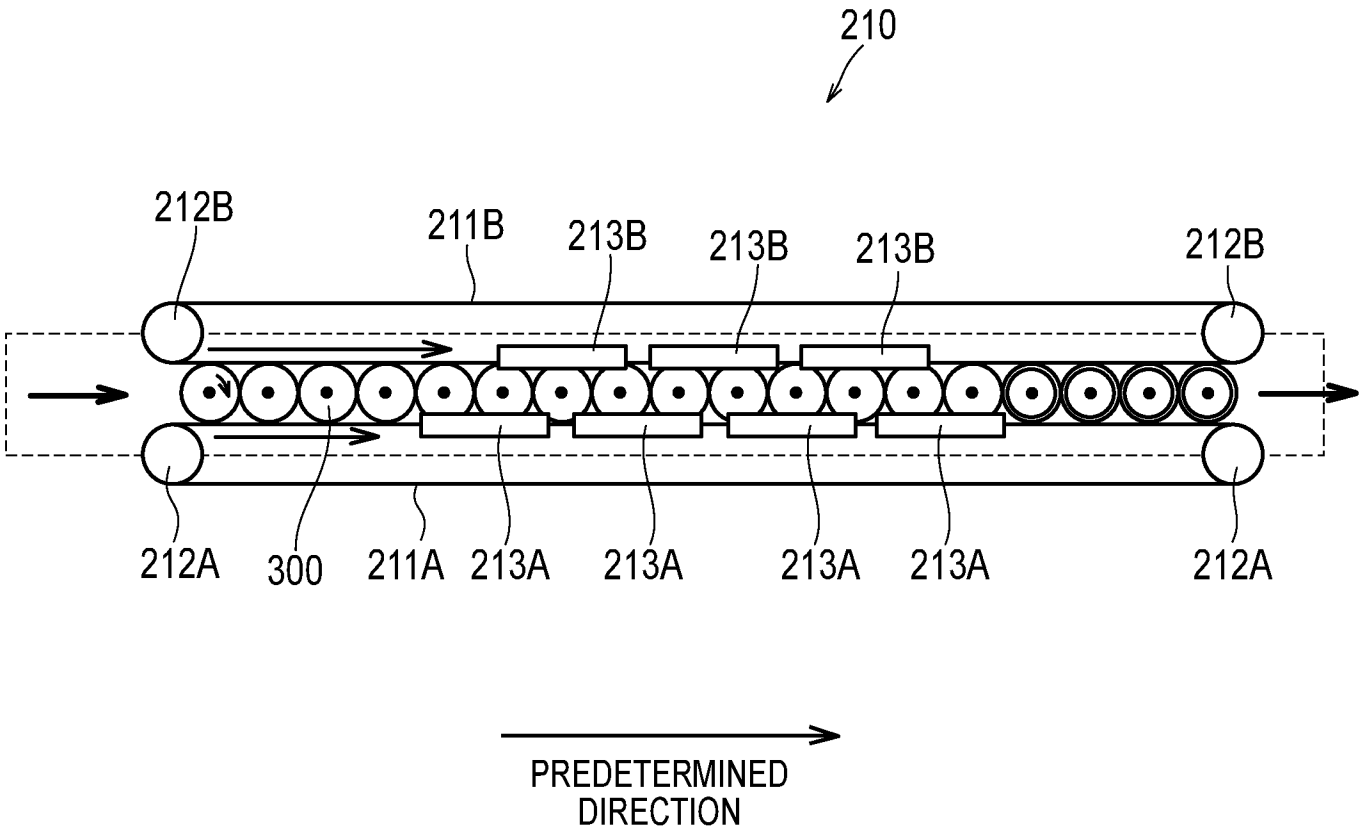
FIG. 5 is a diagram for describing an example of a chamfering step (step S10) according to the first embodiment.

An example of a chamfering step (step S10) according to the first embodiment will be described, below. FIG. 5 is a diagram for describing an example of the chamfering step (step S10) according to the first embodiment.

As shown in FIG. 5, a chamfering processing device 210 has: a pair of transport belts (a transport belt 211A and a transport belt 211B); a plurality of transport rollers (a transport roller 212A and a transport roller 212B); and a plurality of chamfering members (a chamfering member 213A and a chamfering member 213B).

The transport belt 211A is wound around the plurality of transport rollers 212A. Likewise, the transport belt 211B is wound around the plurality of transport rollers 212B. The transport belt 211A and the transport belt 211B sandwich side surfaces of the plurality of carbon members 300, and transport the plurality of carbon members 300 along a predetermined direction.

The transport roller 212A is configured to enable rotation, and the transport belt 211A circles along with the rotation of the transport roller 212A. Likewise, the transport roller 212B is configured to enable rotation, and the transport belt 211B circles along with the rotation of the transport roller 212B. The transport roller 212A and the transport roller 212B are configured to rotate at a respectively different speed.

The chamfering member 213A is disposed to contact the outer circumference of the ignition end of the carbon member 300, is arranged along a predetermined direction (transport direction of the carbon member 300), and is arranged at the side of the transport belt 211A. Likewise, the chamfering member 213B is disposed to contact the outer circumference of the ignition end of the carbon member 300, is arranged along a predetermined direction (transport direction of the carbon member 300), and is arranged at the side of the transport belt 211B. The chamfering member 213A and the chamfering member 213B are a file or the like to cut the outer circumference of the ignition end of the carbon member 300.

It is noted that the chamfering member 213A and the transport belt 211A may be arranged as a respectively independent article, and may be an article arranged as one unit. Likewise, the chamfering member 213B and the transport belt 211B may be arranged as a respectively independent article, and may be an article arranged as one unit.

Here, the above-described chamfering step (step S10) includes a step B1 and a step B2. The step B1 is a step is a step of turning each of the plurality of carbon members 300 around a turning axis along a longitudinal axis direction (the first direction D1 shown in FIG. 3) by a speed difference between the pair of transport belts while transporting the plurality of carbon members 300 along a predetermined direction by a pair of transport belts (the transport belt 211A and the transport belt 211B) sandwiching the plurality of carbon members 300 from side surfaces of the plurality of carbon members 300, in a state where the plurality of carbon members 300 are aligned in one line along a predetermined direction. The step B2 is a step of bringing the chamfering member (the chamfering member 213A and the chamfering member 213B) disposed along a predetermined direction into contact with the outer circumference of the ignition end, in a state where each of the plurality of carbon members 300 is turned around the turning axis.

It should be noted here that the speed difference between the pair of transport belts (the transport belt 211A and the transport belt 211B) is caused by a difference between a rotation speed of the transport roller 212A and a rotation speed of the transport roller 212B.

(Example of First-Groove Forming Step)

Figure 6:
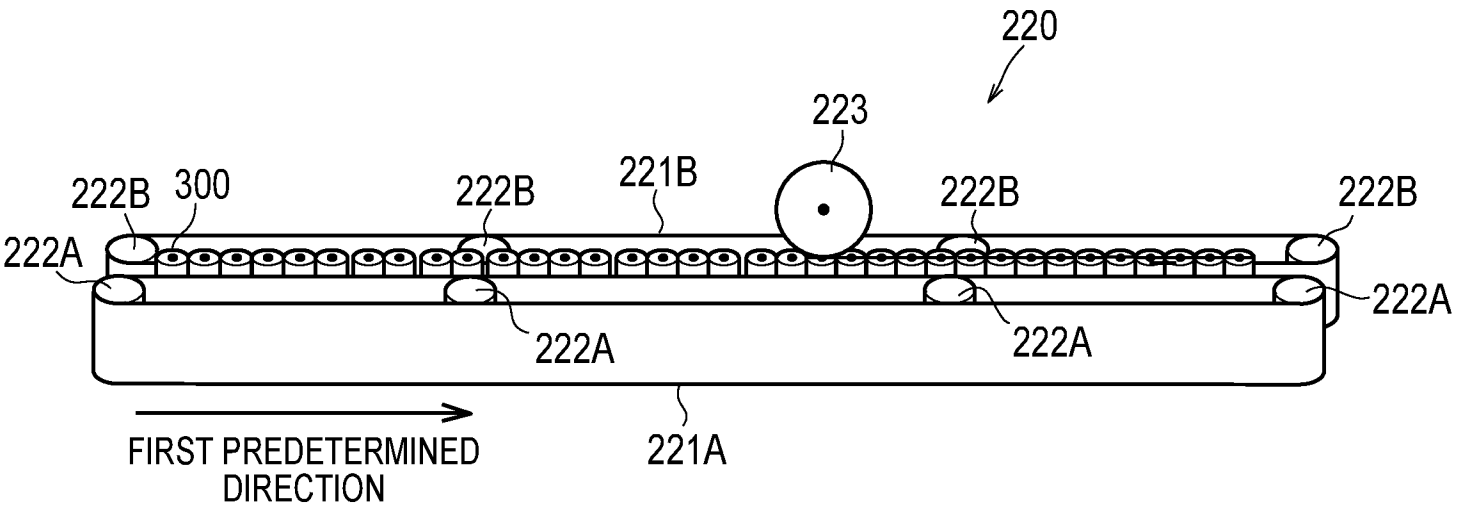
FIG. 6 is a diagram for describing an example of a first-groove forming step (step S20) according to the first embodiment.
Figure 7:
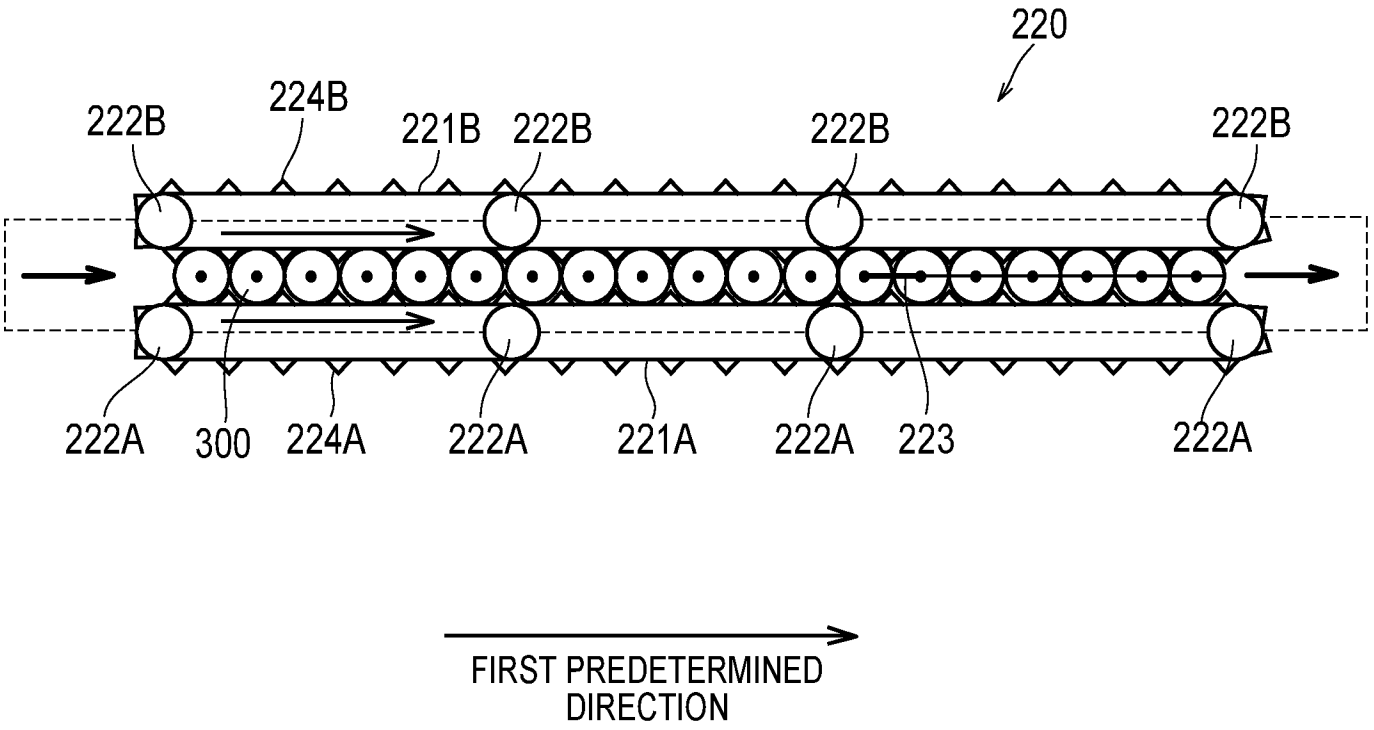
FIG. 7 is a diagram for describing an example of the first-groove forming step (step S20) according to the first embodiment.

An example of a first-groove forming step (step S20) according to the first embodiment will be described, below. FIG. 6 and FIG. 7 are diagrams for describing an example of the first-groove forming step (step S20) according to the first embodiment. It is noted that FIG. 6 is a side view of a groove forming device 220 and FIG. 7 is a top view of the groove forming device 220.

As shown in FIG. 6 and FIG. 7, the groove forming device 220 has: a pair of transport belts (a transport belt 221A and a transport belt 221B); a plurality of transport rollers (a transport roller 222A and a transport roller 222B); a cutter 223; and a plurality of protrusions (a protrusion 224A and a protrusion 224B).

The transport belt 221A is wound around the plurality of transport rollers 222A. Likewise, the transport belt 221B is wound around the plurality of transport rollers 222B. The transport belt 221A and the transport belt 221B sandwich side surfaces of the plurality of carbon members 300, and transport the plurality of carbon members 300 along a first predetermined direction. Thus, when the carbon member 300 is sandwiched by the plurality of transport belts, it is possible to restrain the carbon member 300 from turning during transportation.

The transport roller 222A is configured to enable rotation, and the transport belt 221A circles along with the rotation of the transport roller 222A. Likewise, the transport roller 222B is configured to enable rotation, and the transport belt 221B circles along with the rotation of the transport roller 222B. The transport roller 222A and the transport roller 222B are configured to rotate at the same speed.

The cutter 223 is a rotor which is disposed to contact the ignition end of the carbon member 300 and which is configured to form, at the ignition end of the carbon member 300, a first groove along a first predetermined direction. That is, the cutter 223 is an example of a first groove cutting member.

The protrusion 224A is arranged in the transport belt 221A, and serves a function of further preventing each turning of the plurality of carbon members 300. Specifically, the protrusion 224A has a shape protruding from the transport belt 221A toward a side surface of the carbon member 300, and a pair of respectively adjacent protrusions 224A support the carbon member 300 from a side of the transport belt 221A. The surface of the protrusion 224A is preferably configured from a member having a high friction coefficient (rubber, for example) to prevent the rotation of the carbon member 300, for example. Likewise, the protrusion 224B is arranged in the transport belt 221B, and serves a function of further preventing each turning of the plurality of carbon members 300. Specifically, the protrusion 224B has a shape protruding from the transport belt 221B toward a side surface of the carbon member 300, and a pair of respectively adjacent protrusions 224B support the carbon member 300 from a side of the transport belt 221B. The surface of the protrusion 224B is preferably configured from a member having a high friction coefficient (rubber, for example) to prevent the rotation of the carbon member 300, for example. The protrusion 224A and the protrusion 224B are arranged at a position to face each other.

As shown in FIG. 7, the carbon member 300 is carried by the pair of respectively adjacent protrusions 224A and the pair of respectively adjacent protrusions 224B, and thus, the rotation of the carbon member 300 is more effectively prevented. It is noted that the protrusion 224A and the protrusion 224B are not an essential configuration, and the rotation of the carbon member 300 may be prevented as a result only of the carbon member 300 being held by the plurality of transport belts.

That is, the above-described first-groove forming step (step S20) may be expressed as follows: Step S20 is a step of forming the first groove along the first predetermined direction by bringing an ignition end of each of the plurality of carbon members 300 into contact with the cutter 223 in a state where the plurality of carbon members 300 are aligned in one line along the first predetermined direction while the plurality of carbon members 300 are being transported along the first predetermined direction. Further, step S20 includes a step of transporting the plurality of carbon members along the first predetermined direction by the pair of first transport belts (the transport belt 221A and the transport belt 221B) that sandwich the plurality of carbon members 300 from side surfaces of the plurality of carbon members 300.

(Example of Second-Groove Forming Step)

Figure 8:
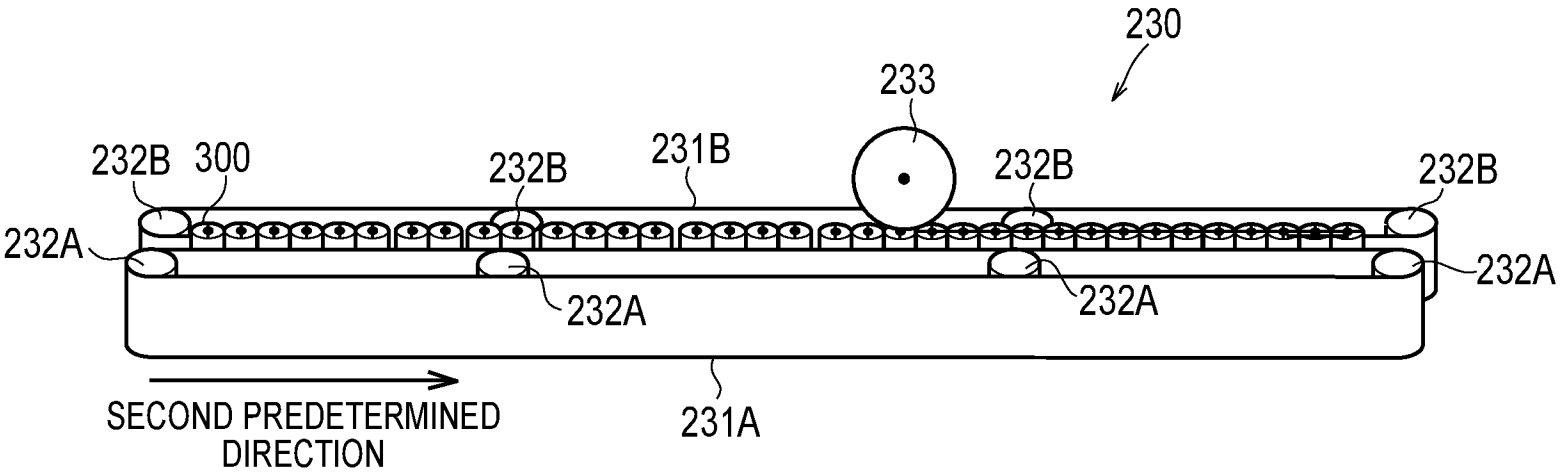
FIG. 8 is a diagram for describing an example of a second-groove forming step (step S40) according to the first embodiment.
Figure 9:
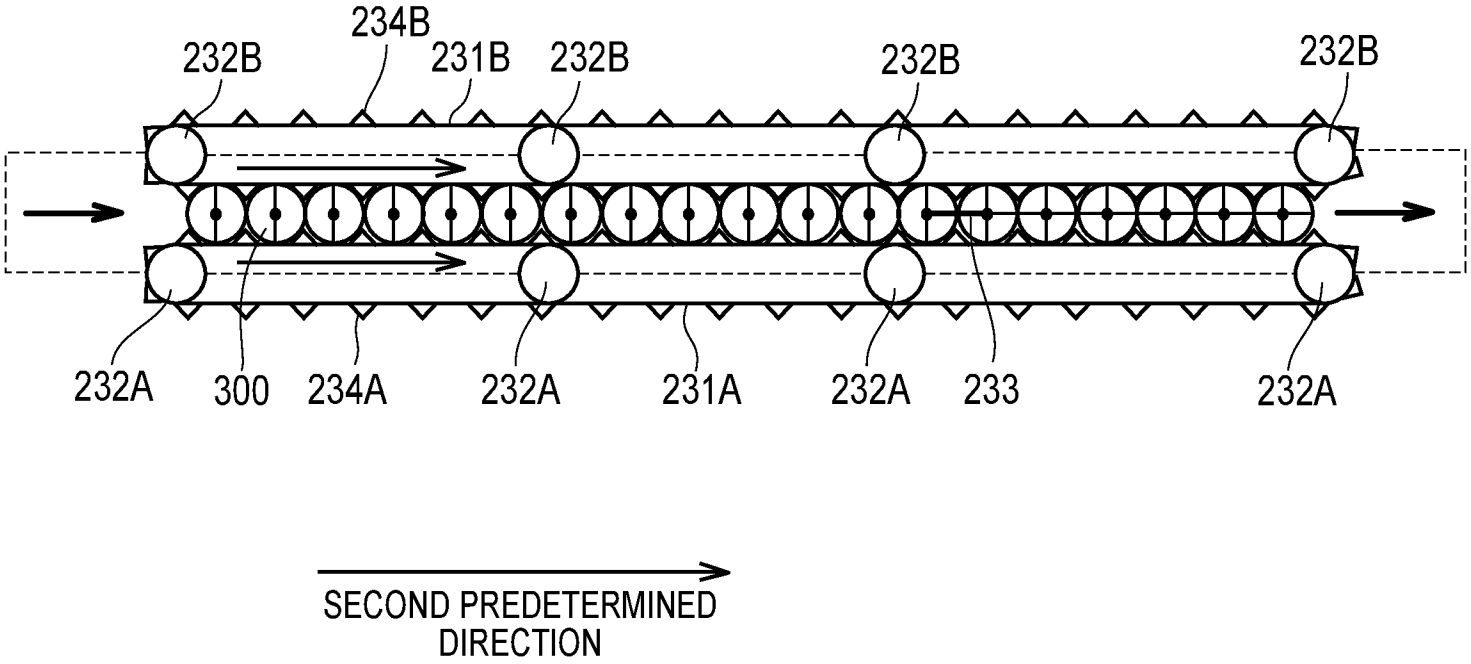
FIG. 9 is a diagram for describing an example of the second-groove forming step (step S40) according to the first embodiment.

An example of a second-groove forming step (step S40) according to the first embodiment will be described, below. FIG. 8 and FIG. 9 are diagrams for describing an example of the second-groove forming step (step S40) according to the first embodiment. It is noted that FIG. 8 is a side view of a groove forming device 230 and FIG. 9 is a top view of the groove forming device 230.

As shown in FIG. 8 and FIG. 9, the groove forming device 230 has: a pair of transport belts (a transport belt 231A and a transport belt 231B); a plurality of transport rollers (a transport roller 232A and a transport roller 232B); a cutter 233; and a plurality of protrusions (a protrusion 234A and a protrusion 234B).

The transport belt 231A is wound around the plurality of transport rollers 232A. Likewise, the transport belt 231B is wound around the plurality of transport rollers 232B. The transport belt 231A and the transport belt 231B sandwich side surfaces of the plurality of carbon members 300, and transport the plurality of carbon members 300 along a second predetermined direction. Thus, when the carbon member 300 is sandwiched by the plurality of transport belts, it is possible to restrain the carbon member 300 from turning during transportation.

The transport roller 232A is configured to enable rotation, and the transport belt 231A circles along with the rotation of the transport roller 232A. Likewise, the transport roller 232B is configured to enable rotation, and the transport belt 231B circles along with the rotation of the transport roller 232B. The transport roller 232A and the transport roller 232B are configured to rotate at the same speed.

The cutter 233 is a rotor which is disposed to contact the ignition end of the carbon member 300 and which is configured to form, at the ignition end of the carbon member 300, a second groove along a second predetermined direction. That is, the cutter 233 is an example of a second groove cutting member.

The protrusion 234A is arranged in the transport belt 231A, and serves a function of further preventing each turning of the plurality of carbon members 300. Specifically, the protrusion 234A has a shape protruding from the transport belt 231A toward a side surface of the carbon member 300, and a pair of respectively adjacent protrusions 234A support the carbon member 300 from a side of the transport belt 231A. The surface of the protrusion 234A is preferably configured from a member having a high friction coefficient (rubber, for example) to prevent the rotation of the carbon member 300, for example. Likewise, the protrusion 234B is arranged in the transport belt 231B, and serves a function of further preventing each turning of the plurality of carbon members 300. Specifically, the protrusion 234B has a shape protruding from the transport belt 231B toward a side surface of the carbon member 300, and a pair of respectively adjacent protrusions 234B support the carbon member 300 from a side of the transport belt 231B. The surface of the protrusion 234B is preferably configured from a member having a high friction coefficient (rubber, for example) to prevent the rotation of the carbon member 300, for example. The protrusion 234A and the protrusion 234B are arranged at a position to face each other.

As shown in FIG. 9, the carbon member 300 is supported by the pair of respectively adjacent protrusions 234A and the pair of respectively adjacent protrusions 234B, and thus, the rotation of the carbon member 300 is prevented. It is noted that the protrusion 234A and the protrusion 234B are not an essential configuration, and the rotation of the carbon member 300 may be prevented as a result only of the carbon member 300 being sandwiched by the plurality of transport belts.

That is, the above-described second groove forming step (step S40) may be expressed as follows: Step S40 is a step of forming, along the second predetermined direction, the second groove crossing the first groove by bringing an ignition end of each of the plurality of carbon members 300 into contact with the cutter 233 in a state where the plurality of carbon members 300 are aligned in one line along the second predetermined direction while the plurality of carbon members 300 are being transported along the second predetermined direction. Further, step S40 includes a step of transporting the plurality of carbon members along the second predetermined direction by the pair of second transport belts (the transport belt 231A and the transport belt 231B) that sandwich the plurality of carbon members 300 from side surfaces of the plurality of carbon members 300.

(First Example of Carbon-Heat-Source Orientation Changing Step)

Figure 10:
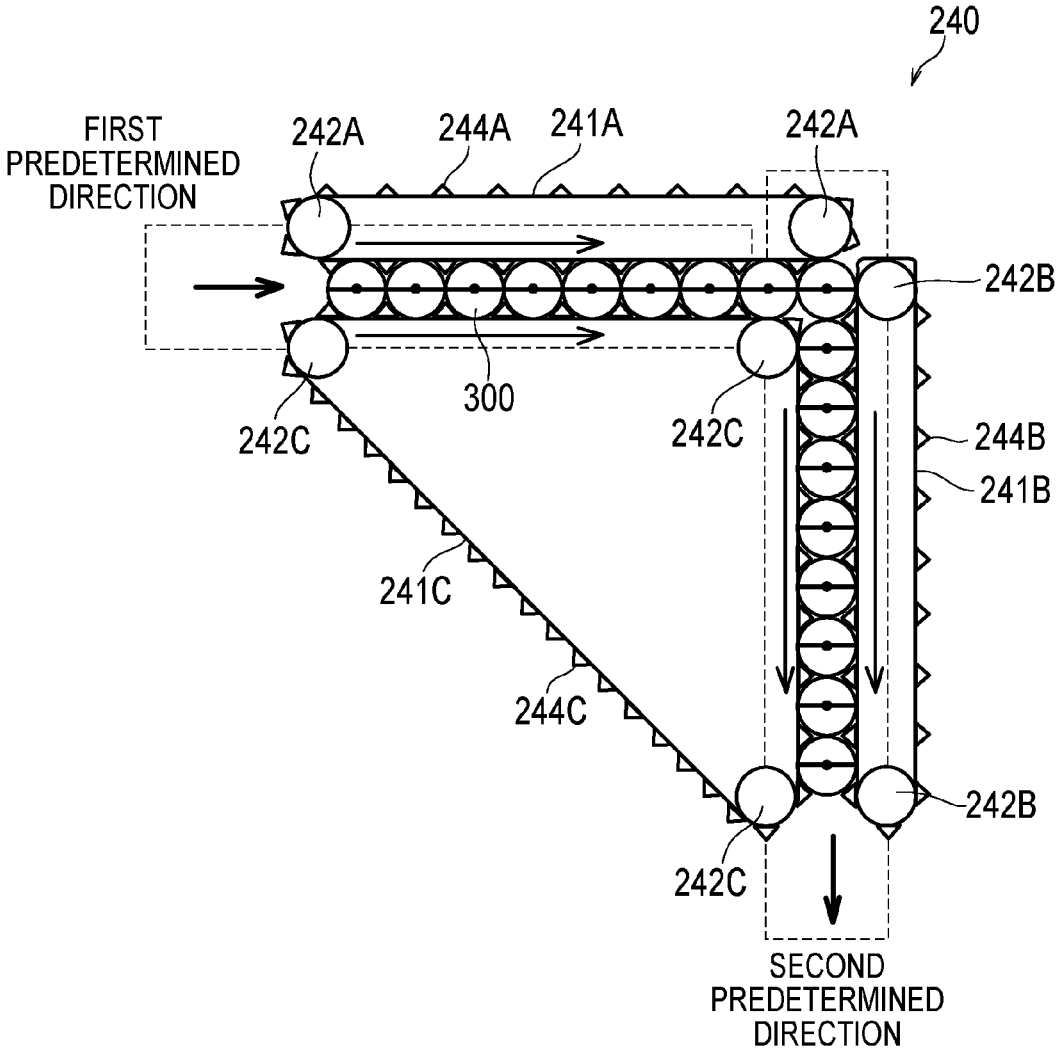
FIG. 10 is a diagram for describing a first example of a carbon-heat-source orientation changing step (step S30) according to the first embodiment.

A first example of a carbon-heat-source orientation changing step (step S30) according to the first embodiment will be described, below. FIG. 10 is a diagram for describing a first example of a carbon-heat-source orientation changing step (step S30) according to the first embodiment.

As shown in FIG. 10, the transport apparatus 240 has: a plurality of transport belts (a transport belt 241A, a transport belt 241B, and a transport belt 241C); a plurality of transport rollers (a transport roller 242A, a transport roller 242B, and a transport roller 242C); and a plurality of protrusions (a protrusion 244A, a protrusion 244B, and a protrusion 244C).

The transport belt 241A is wound around the plurality of transport rollers 242A. Likewise, the transport belt 241B is wound around the plurality of transport rollers 242B. Likewise, the transport belt 241C is wound around the plurality of transport rollers 242C. It should be noted, however, that the transport belt 241C includes a portion to face the transport roller 242A along the first predetermined direction and a portion to face the transport belt 241B along the second predetermined direction. Further, the first predetermined direction and the second predetermined direction cross each other. The transport bolt 241A and the transport belt 241C sandwich side surfaces of the plurality of carbon members 300, and transport the plurality of carbon members 300 along a predetermined first direction. The transport belt 241B and the transport belt 241C sandwich side surfaces of the plurality of carbon members 300, and transport the plurality of carbon members 300 along a second predetermined first direction.

The transport roller 242A is configured to enable rotation, and the transport belt 241A circles along with the rotation of the transport roller 242A. Likewise, the transport roller 242B is configured to enable rotation, and the transport belt 241B circles along with the rotation of the transport roller 242B. Likewise, the transport roller 242C is configured to enable rotation, and the transport belt 241C circles along with the rotation of the transport roller 242C. The transport roller 242A, the transport roller 242B, and the transport roller 242C are configured to rotate at the same speed.

The protrusion 244A is arranged in the transport belt 241A, and prevents each turning of the plurality of carbon members 300. Specifically, the protrusion 244A has a shape protruding from the transport belt 241A toward a side surface of the carbon member 300, and a pair of respectively adjacent protrusions 244A support the carbon member 300 from a side of the transport belt 241A. The surface of the protrusion 244A is preferably configured from a member having a high friction coefficient (rubber, for example) to prevent the rotation of the carbon member 300, for example. Likewise, the protrusion 244B is arranged in the transport belt 241B, and prevents each turning of the plurality of carbon members 300. Specifically, the protrusion 244B has a shape protruding from the transport belt 241B toward a side surface of the carbon member 300, and a pair of respectively adjacent protrusions 244B support the carbon member 300 from a side of the transport belt 241B. The surface of the protrusion 244B is preferably configured from a member having a high friction coefficient (rubber, for example) to prevent the rotation of the carbon member 300, for example. The protrusion 244A and the protrusion 244B are arranged at a position to face each other. The protrusion 244C is arranged in the transport belt 241C, and prevents each turning of the plurality of carbon members 300. Specifically, the protrusion 244C has a shape protruding from the transport belt 241C toward a side surface of the carbon member 300, and a pair of respectively adjacent protrusions 244C support the carbon member 300 from a side of the transport belt 241C. The surface of the protrusion 244C is preferably configured from a member having a high friction coefficient (rubber, for example) to prevent the rotation of the carbon member 300, for example. The protrusion 244A and the protrusion 244C are arranged at a position to face each other. Likewise, the protrusion 244B and the protrusion 244C are arranged at a position to face each other.

As shown in FIG. 10, the carbon member 300 is supported by the pair of respectively adjacent protrusions 244A and the pair of respectively adjacent protrusions 244C, and thus, the rotation of the carbon member 300 is prevented. Likewise, the carbon member 300 is supported by the pair of respectively adjacent protrusions 244B and the pair of respectively adjacent protrusions 244C, and thus, the rotation of the carbon member 300 is prevented.

That is, the above-described carbon-heat-source orientation changing step (step S30) may be expressed as follows: Step S30 is a step of passing the plurality of carbon members from a pair of first transport belts (the transport belt 241A and the transport belt 241C) to a pair of second transport belts (the transport belt 241B and the transport belt 241C).

The groove forming device 220 configured to form the first groove is arranged in an upstream step for the transport apparatus 240, and the groove forming device 230 configured to form the second groove is arranged in a downstream step for the transport apparatus 240. Accordingly, the transport belt 241A and the transport belt 241C configured to transport the carbon member 300 along the first predetermined direction may be a part of the transport belt 221A and the transport belt 221B, and may also be continued to the transport belt 221A and the transport belt 221B. Likewise, the transport belt 241B and the transport belt 241C configured to transport the carbon member 300 along the second predetermined direction may be a part of the transport belt 231A and the transport belt 231B, and may also be continued to the transport belt 231A and the transport belt 231B.

(Second Example of Carbon-Heat-Source Orientation Changing Step)

Figure 11:
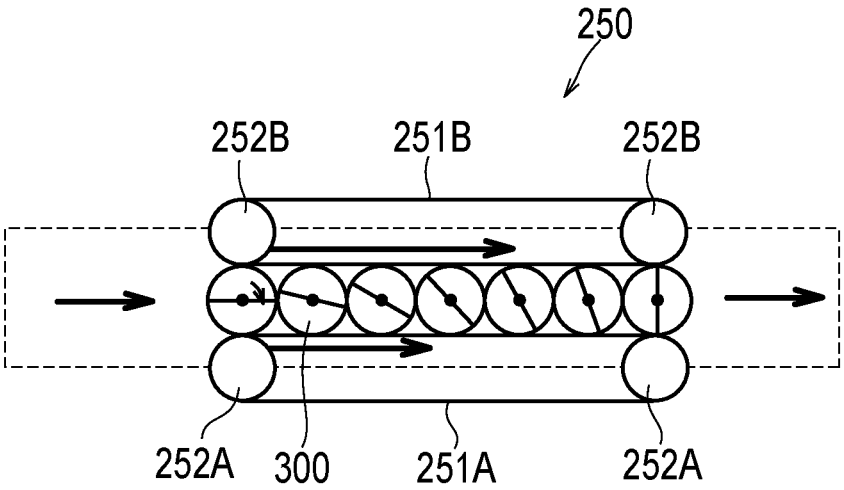
FIG. 11 is a diagram for describing a second example of the carbon-heat-source orientation changing step (step S30) according to the first embodiment.

A second example of the carbon-heat-source orientation changing step (step S30) according to the first embodiment will be described, below. FIG. 11 is a diagram for describing a second example of the carbon-heat-source orientation changing step (step S30) according to the first embodiment.

As shown in FIG. 5, a transport apparatus 250 has: a pair of transport belts (a transport belt 251A and a transport belt 251B); and a plurality of transport rollers (a transport roller 252A and a transport roller 252B).

The transport belt 251A is wound around the plurality of transport rollers 252A. Likewise, the transport belt 251B is wound around the plurality of transport rollers 252B. The transport belt 251A and the transport belt 251B sandwich side surfaces of the plurality of carbon members 300, and transport the plurality of carbon members 300 along a predetermined direction.

The transport roller 252A is configured to be rotatable, and the transport belt 251A circles along with the rotation of the transport roller 252A. Likewise, the transport roller 252B is configured to be rotatable, and the transport belt 251B circles along with the rotation of the transport roller 252B. The transport roller 252A and the transport roller 252B are configured to rotate at a respectively different speed.

That is, the above-described carbon-heat-source orientation changing step (step S30) may be expressed as follows: Step S30 is a step of turning each of the plurality of carbon members 300 around a turning axis along a longitudinal axis direction (first direction D1 shown in FIG. 3) by a speed difference between the pair of transport belts while transporting the plurality of carbon members 300 by a pair of transport belts (the transport belt 251A and the transport belt 251B) sandwiching the plurality of carbon members from side surfaces of the plurality of carbon members 300.

It should be noted here that the speed difference between the pair of transport belts (the transport belt 251A and the transport belt 251B) is caused by a difference between a rotation speed of the transport roller 252A and a rotation speed of the transport roller 252B.

As described above, in the second example, it is possible to turn the carbon member 300 by the speed difference between a pair of transport belts (the transport belt 251A and the transport belt 251B). Thus, in the second example, even when the first predetermined direction and the second predetermined direction are in the same orientation, it is possible to manufacture the burning type heat source 50 having the first groove and the second groove crossing each other.

The groove forming device 220 configured to form the first groove is arranged in an upstream step for the transport apparatus 250, and the groove forming device 230 configured to form the second groove is arranged in a downstream step for the transport apparatus 250. Accordingly, the transport belt 251A and the transport belt 251B may be a part of the transport belt 221A and the transport belt 221B, and may also be continued to the transport belt 221A and the transport belt 221B. Likewise, the transport belt 251A and the transport belt 251B may be a part of the transport belt 231A and the transport belt 231B, and may also be continued to the transport belt 231A and the transport belt 231B.

(Operation and Effect)

In the first embodiment, when step S30 (the step A2) of changing the orientation of the plurality of carbon members 300 is executed between step S20 (the step A1) and step S40 (the step A3), the groove 54A (first groove) and the groove 54B (second groove) crossing the groove 54A are formed in a state where the plurality of carbon members 300 are aligned in one line. Accordingly, it is possible to continuously manufacture a large number of carbon heat sources formed with a cross groove, and possible to improve a productivity of the carbon heat source.

Further, as shown in FIG. 10 to FIG. 11, when the step (step A2) of changing the orientation of the carbon member 300 is provided, it is easy to arbitrarily adjust a crossing angle between the groove 54A and the groove 54B and a design freedom of the groove 54 formed in the carbon member 300 is increased.

[First Modification]

A first modification of the first embodiment will be described, below. Description proceeds with a particular focus on a difference from the first embodiment, below.

Specifically, in the first embodiment, the carbon member 300 is transported by the pair of transport belts. On the other hand, in the first modification, a plurality of holders configured to individually hold each of the plurality of carbon members 300 are used to transport the carbon member 300.

Figure 12:
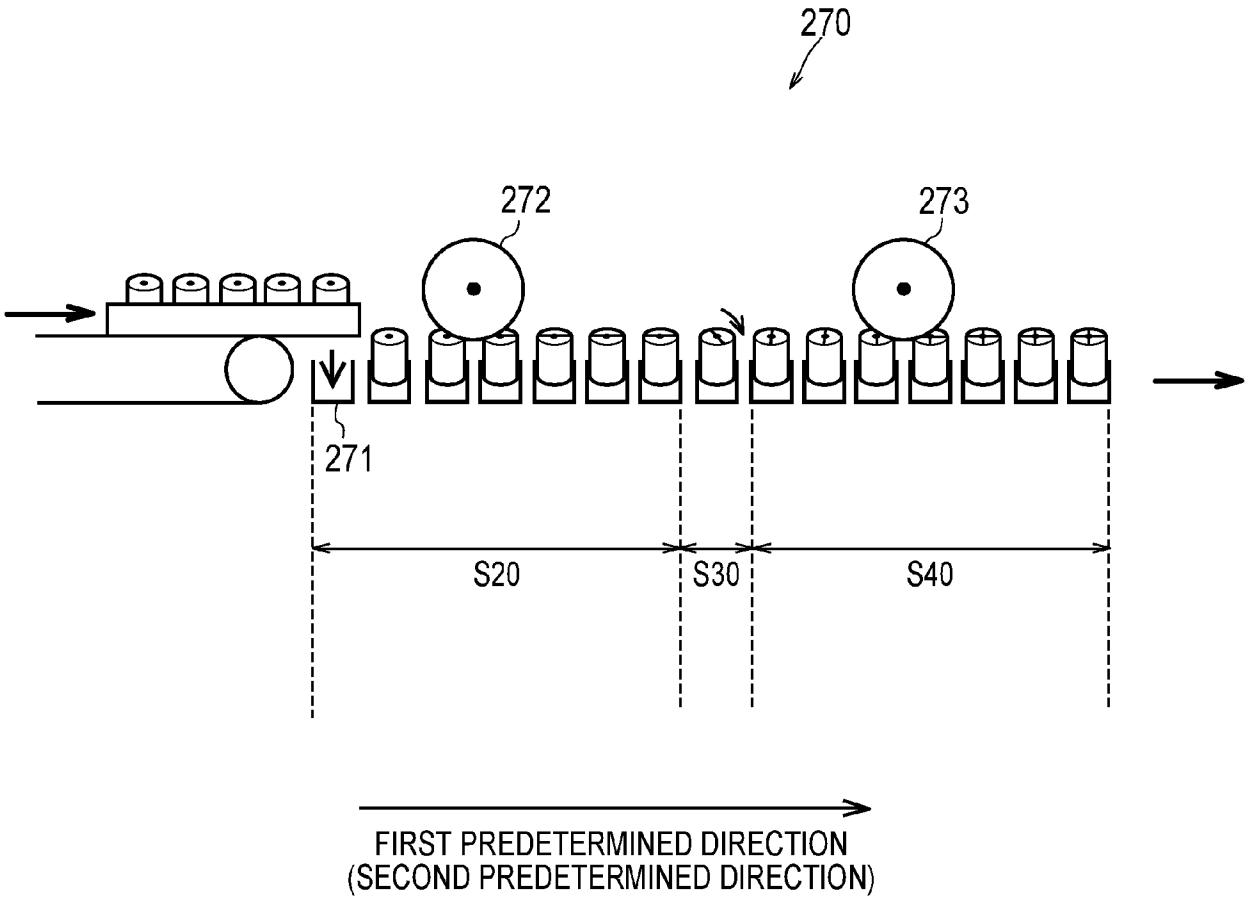
FIG. 12 is a drawing for describing a manufacturing method for a burning type heat source 50 according to a first modification.

Specifically, as shown in FIG. 12, a manufacturing apparatus 270 has a plurality of holders 271, a cutter 272, and a cutter 273.

The holders 271 are members configured to individually hold the carbon members 300. The holder 271 is configured to be transported along the first predetermined direction. Further, the holder 271 is configured to be transported along the second predetermined direction. The holder 271 is configured to enable turning while holding the carbon member 300, in a line between the cutter 272 and the cutter 273.

As described above, in the first modification, it is possible to turn the carbon member 300 held in the holder 271 along with the turning of the holder 271. Thus, in the first modification, even when the first predetermined direction and the second predetermined direction are in the same orientation, it is possible to manufacture the burning type heat source 50 having the first groove and the second groove crossing each other.

The cutter 272 is a rotor which is disposed to contact the ignition end of the carbon member 300 and which is configured to form a first groove along a first predetermined direction at the ignition end of the carbon member 300. That is, in the above-described step S20, when contacting the ignition end of the carbon member 300 transported by the holder 271, the cutter 272 forms the first groove at the ignition end of the carbon member 300.

The cutter 273 is a rotor which is disposed to contact the ignition end of the carbon member 300 and which is configured to form a second groove along a second predetermined direction at the ignition end of the carbon member 300. That is, in the above-described step S40, when contacting the ignition end of the carbon member 300 transported by the holder 271, the cutter 273 forms the second groove at the ignition end of the carbon member 300.

That is, the above-described first-groove forming step (step S20) may be expressed as follows: Step S20 (a step A1) includes a step of transporting the plurality of carbon members 300 along the first predetermined direction, by using the plurality of holders 271 configured to individually hold each of the plurality of carbon members 300. The above-described second-groove forming step (step S40) may be expressed as follows: Step S40 (a step A3) includes a step of transporting the plurality of carbon members 300 along the second predetermined direction by using the plurality of holders 271. The above-described carbon-heat-source orientation changing step (step S30) may be expressed as follows: Step S30 (step A2) is a step of turning each of the plurality of carbon members 300 around a turning axis along a longitudinal axis direction (the first direction D1 shown in FIG. 3) by the turning of each of the plurality of holders 271.

[Reference Example]

A reference example of the first embodiment will be described, below. Description proceeds with a particular focus on a difference from the first embodiment, below.

Specifically, in the reference example, a plurality of grooves are formed at the ignition end of the carbon member 300 when each of the plurality of carbon members 300 is not turned.

Figure 13:
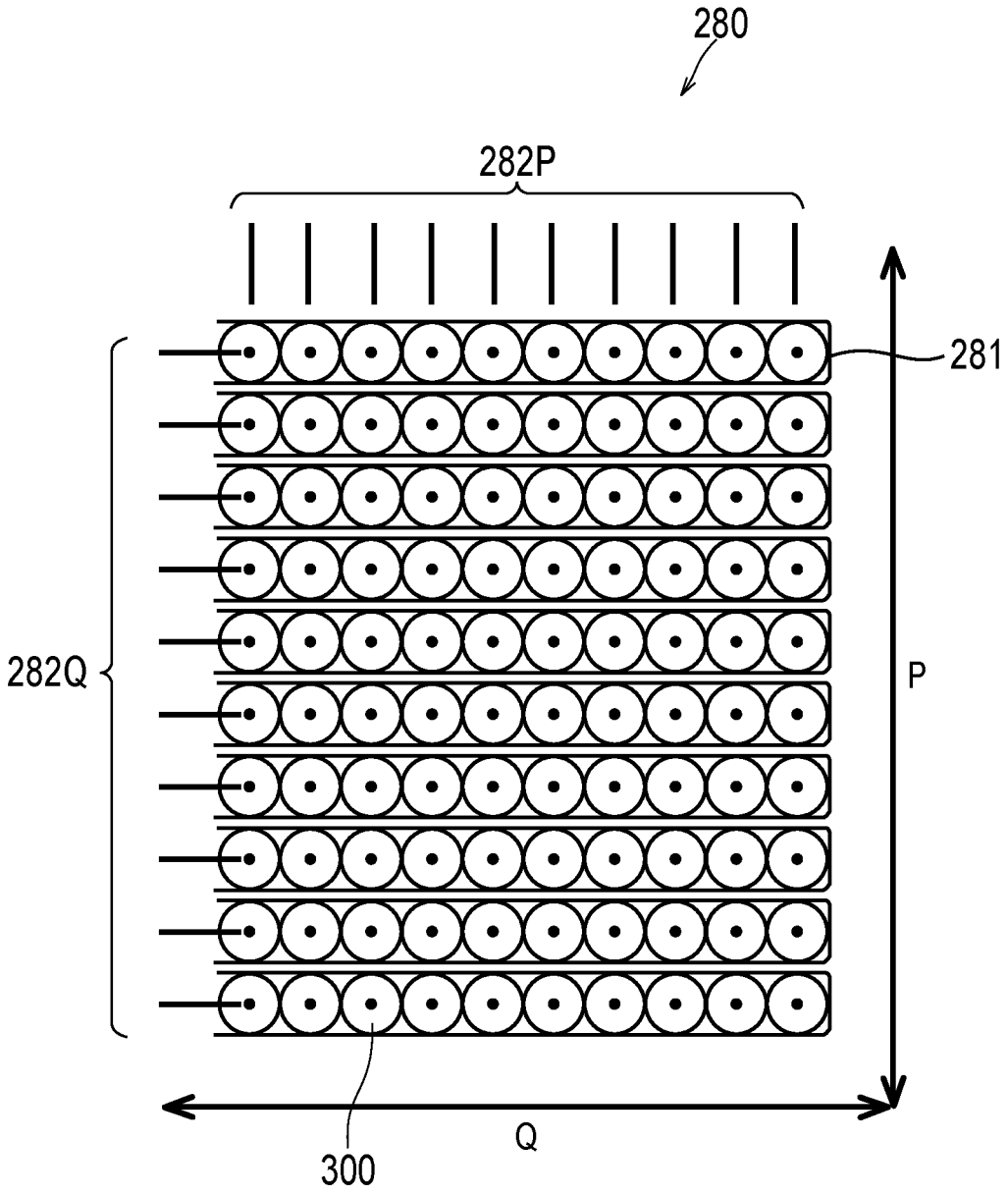
FIG. 13 is a drawing for describing a manufacturing method for a burning type heat source 50 according to a reference example.

Specifically, as shown in FIG. 13, a manufacturing apparatus 280 has a plurality of racks 281, a plurality of cutters 282P, and a plurality of cutters 282Q.

Each of the plurality of racks 281 houses the plurality of carbon members 300. Specifically, each rack 281 has a shape extending along a Q direction and houses the plurality of carbon members 300 aligned along the Q direction. Further, the plurality of racks 281 are aligned along a P direction perpendicular to the Q direction.

The plurality of cutters 282P are aligned along the Q direction. Further, each cutter 282P is configured to enable movement along the P-direction. More particularly, the cutter 282P is a rotor configured to form the first groove along P-direction at the ignition end of the carbon member 300.

The plurality of cutters 282Q are aligned along the P-direction. Further, each cutter 282Q is configured to enable movement along the Q direction. More particularly, the cutter 282Q is a rotor configured to form the second groove along a Q direction at the ignition end of the carbon member 300.

[Other Embodiments]

The present invention is described through the above-described embodiments, but it should not be understood that this invention is limited by the statements and the drawings constituting a part of this disclosure. From this disclosure, various alternative embodiments, examples, and operational technologies will become apparent to those skilled in the art.

In the embodiment, there are two grooves formed at the ignition end of the carbon member 300. However, the embodiment is not limited thereto. There may be three or more grooves formed at the ignition end of the carbon member 300, for example.

In the embodiments, the carbon member 300 has a circular cylindrical shape. However, the embodiment is not limited thereto. The carbon member 300 suffices to have a pillar-like shape, and may include a quadrangular prism shape and a hexagonal prism shape, for example.

In the embodiment, the chamfering step (step S10/step B) is performed before the groove forming step (step S20 to step S40/step A). However, the embodiment is not limited thereto. The chamfering step (step S10/step B) may be performed after the groove forming step (step S20 to step S40/step A). It is noted that when the chamfering step (step S10/step B) is performed before the groove forming step (step S20 to step S40/step A), as compared to a case where the chamfering step is performed after the groove forming step, it is possible to more effectively prevent missing of the carbon member 300 in the chamfering step, for example.

INDUSTRIAL APPLICABILITY

According to the present invention, it is possible to continuously manufacture a large number of carbon heat sources formed with a cross groove.

The invention claimed is:

1. A manufacturing method for a heat source made of carbon, the method comprises the following steps:

providing a plurality of carbon members, each said carbon members having a pillar-like profile with an ignition end formed at a proximal end and a non-ignition end formed at a distal end;

a step A including:

step A1—conveying in a first predetermined direction along transport belts, the plurality of carbon members with the ignition end projecting upwardly wherein the plurality of carbon members are aligned in one line along the first predetermined direction, forming a first groove in the ignition end of each of the plurality of carbon members, said first groove extending along the first predetermined direction in each of the plurality of carbon members and said first groove extending in a longitudinal axis direction from the ignition end towards the non-ignition end of each of the plurality of carbon members, transporting the plurality of carbon members along the first predetermined direction;

step A2—changing, subsequent to the step A1 being performed, an orientation of the plurality of carbon members by using transport belts so that the first groove formed in each of the plurality of carbon members is at a predetermined angle relative to the first predetermined direction in a state where each of the plurality of carbon members is aligned in one line while transporting the plurality of carbon members; and step A3—forming, subsequent to the step A2 being performed, a second groove crossing the first groove along a second predetermined direction in each of the plurality of carbon members, said second groove extending in the longitudinal axis direction from the ignition end towards the non-ignition end of each of the plurality of carbon members, wherein the plurality of carbon members are aligned in one line along the second predetermined direction while using transport belts for transporting the plurality of carbon members along the second predetermined direction.

2. The manufacturing method for the heat source made of carbon according to claim 1, wherein the step A2 is a step of turning each of the plurality of carbon members around a turning axis along the longitudinal axis direction while transporting the plurality of carbon members.

3. The manufacturing method for the heat source made of carbon according to claim 1, further comprising a step B of chamfering an outer circumference of the ignition end of the plurality of carbon members.

4. The manufacturing method for the heat source made of carbon according to claim 3, comprising the step B before the step A.

5. The manufacturing method for the heat source made of carbon according to claim 3, comprising the step B after the step A.

6. The manufacturing method for the heat source made of carbon according to claim 3, wherein the step B includes:

a step B1 of turning each of the plurality of carbon members around a turning axis along the longitudinal axis direction while transporting the plurality of carbon members, in a state where the plurality of carbon members are aligned in one line along a predetermined direction; and a step B2 of chamfering the outer circumference of the ignition end of the plurality of carbon members in a state where each of the plurality of carbon members is turned around the turning axis.

7. The manufacturing method for the heat source made of carbon according to claim 4, wherein the step B includes:

a step B1 of turning each of the plurality of carbon members around a turning axis along the longitudinal axis direction while transporting the plurality of carbon members, in a state where the plurality of carbon members are aligned in one line along a predetermined direction; and a step B2 of chamfering the outer circumference of the ignition end of the plurality of carbon members in a state where each of the plurality of carbon members is turned around the turning axis.

8. The manufacturing method for heat source made of carbon according to claim 5, wherein the step B includes:

a step B1 of turning each of the plurality of carbon members around a turning axis along the longitudinal axis direction while transporting the plurality of carbon members, in a state where the plurality of carbon members are aligned in one line along a predetermined direction; and a step B2 of chamfering the outer circumference of the ignition end of the plurality of carbon members in a state where each of the plurality of carbon members is turned around the turning axis.

* * * * *